United States Patent [19]

Cohn

[11] 4,305,321

[45] Dec. 15, 1981

[54] ELECTRICAL CONTROL DEVICES

[76] Inventor: James M. Cohn, 1125 Lexington Ave., New York, N.Y. 10021

[21] Appl. No.: 949,584

[22] Filed: Oct. 10, 1978

[51] Int. Cl.[3] ..... G10H 1/02; G10H 5/00

[52] U.S. Cl. ..... 84/1.24; 84/DIG. 7; 84/DIG. 8; 338/69; 338/99; 338/114; 338/185

[58] Field of Search ..... 84/1.01, 1.24, DIG. 7, 84/DIG. 8, DIG. 20, 423 R, 433; 338/69, 99, 114, 185

[56] References Cited

U.S. PATENT DOCUMENTS

| | | | |
|---|---|---|---|
| 3,135,153 | 6/1964 | Lo Duca | 84/433 |
| 3,624,584 | 11/1971 | Ohno | 338/69 |
| 3,626,350 | 12/1971 | Suzuki et al. | 338/69 |
| 3,960,044 | 6/1976 | Nagai et al. | 84/1.01 |
| 3,965,789 | 6/1976 | Pearlman | 84/1.24 |
| 4,044,642 | 8/1977 | Pearlman et al. | 84/1.24 X |
| 4,052,923 | 10/1977 | Cohn | 84/DIG. 7 |
| 4,085,647 | 4/1978 | Adachi | 84/1.24 |
| 4,108,035 | 8/1978 | Alonso | 84/1.01 |

*Primary Examiner*—Stanley J. Witkowski

*Attorney, Agent, or Firm*—Ladas & Parry

[57] ABSTRACT

A potentiometer comprises a support member having first and second support regions and an intermediate region located therebetween, a resistive member supported on the support member at the first support region thereof and having a longitudinal dimension extending transversely of a line from the first support region to the second support region, and a resilient contact member secured to the support member at the second support region and extending over the intermediate region and terminating superjacent the resistive member. The contact member is flexible both about axes which extend parallel to the transverse line and about axes which extend transversely of the transverse line, whereby application of pressure to the contact member at a location over the intermediate region causes the contact member to engage the resistive member and movement of the point of application of pressure perpendicular to the transverse line causes the point of engagement of the resistive member by the contact member to move along the longitudinal dimension of the resistive member.

18 Claims, 14 Drawing Figures

Fig. 6
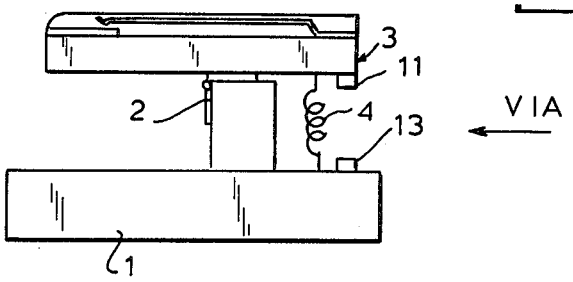
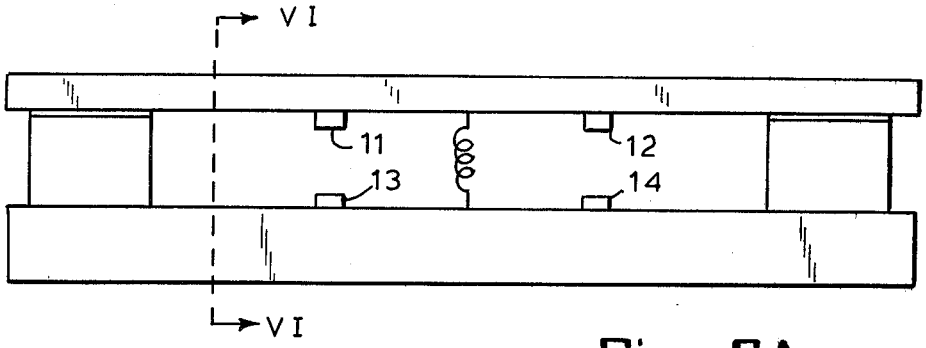
Fig. 6A
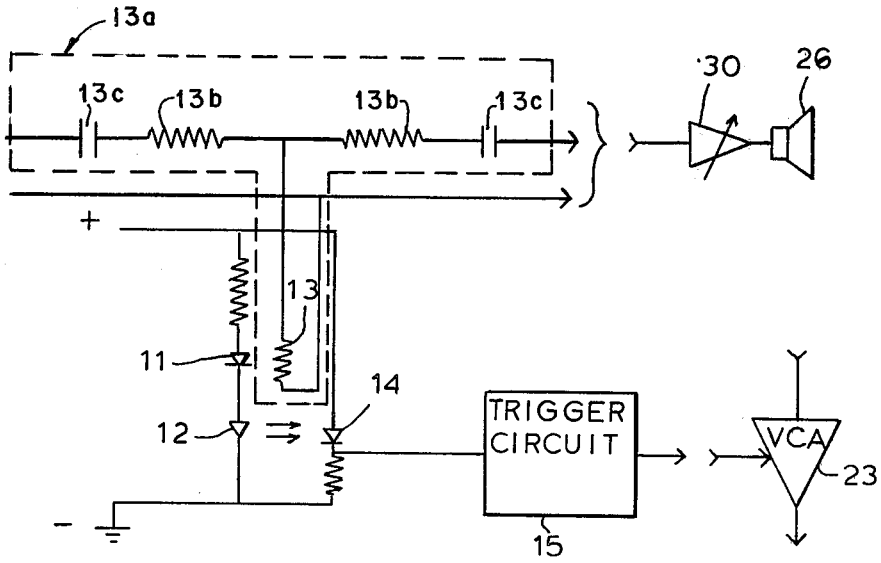
Fig. 6B

ELECTRICAL CONTROL DEVICES

This application discloses improvements in and modifications of the invention disclosed in my U.S. Pat. No. 4,052,923, issued Oct. 11, 1977, the contents of which are hereby incorporated by reference herein.

U.S. Pat. No. 4,052,923 discloses a frequency control strip 5 formed by a potentiometer which comprises an elongate resistive member and a sensing electrode which can be applied to the resistive member at a position intermediate its ends. As shown in FIGS. 2 and 2A of the patent, the frequency control strip 5 comprises a metal strip 6 secured by adhesive on its underside to the upper surface of a slat 3, two lengths of spacer strip 7, for example double adhesive tape, covering the edges of the metal strip 6 but leaving the central area exposed, a resistive strip comprising a length of recording tape 8 having its edges secured to the spacer strips 7 of double adhesive tape and having its magnetic emulsion on the surface facing the metal strip 6, and a protective covering 9 of electrically non-conductive rayon ribbon.

Normally, the spacer strips 7 of double adhesive tape keep the recording tape 8 spaced from the strip 6. However, when pressure is applied to the covering 9, the recording tape 8 is pressed onto the strip 6 and establishes electrical connection therewith.

The electrical arrangement of the strip 6 and the tape 8, which constitute the active parts of a frequency-control voltage source, is illustrated in FIG. 4 of the patent. Thus, the opposite ends of the tape 8 are connected, through a variable range control resistor 10 and a diode drop 33 respectively to the positive and negative poles of a DC voltage source. The metal strip 6 effectively constitutes a wiper contact which taps off from the tape 8 a voltage dependent upon the position along the slat 3 at which pressure is applied to the covering 9, and applies that voltage to the VCO and/or VCF of an electronic music synthesizer, as shown, or to the frequency-related circuitry of a musical instrument.

The recording tape actually used is Scotch No. 208, having a resistance of about 50,000 ohms/inch, and having a width of ¼".

The potentiometer provides the advantages of a linear controller, including the capabilities of making swift and subtle changes of intonation and of producing a true vibrato (continuous fluctuating frequency).

The protective covering 9 of rayon ribbon is not essential to the invention disclosed in the patent, but if no protective covering is provided the fingers of the musician using the frequency control strip will be in continual and/or repeated sliding contact with the back surface of the tape, moving along its length. In such a case, the back of the tape should be provided with an abrasion-resistant coating, for example comprising carbon pigment suspended in a binder.

Magnetic recording tape is relatively flimsy material, not well adapted to subjection to continual and/or repeated pressure and sliding contact under the conditions encountered in the frequency control strip described in the patent (although it is recognized that it is inherent in normal use of magnetic recording tape that it is subject to continual pressure by sliding contact with, the components of a tape recorder or playback machine). Therefore, the magnetic recording tape should preferably have a polyester base (to resist moisture, and for good stability and mechanical characteristics), preferably of greatest standard thickness (about 1.5 mils), and with a magnetic oxide coating of greatest standard oxide-thickness (about 0.65 mils). It is also desirable that the tape and most or all of the remaining parts of the frequency control strip should be made an easily replaceable subunit like a string of a guitar or violin. Under such an arrangement, all or part of the frequency control strip, including its three terminals and perhaps even all or part of the underlying support (the slat 3 of the patent) should be easily removed and replaced, the terminals being provided with plugs or clamps and the rest of the frequency control strip, and possibly also at least part of the support, being removable and replaceable by way of plugs, clamps or adhesives.

In order to provide an electronic musical instrument playable as a violin, viola, cello or double bass, four movable slats as described in the patent, each provided with its own frequency control strip, are arranged in parallel, on a base the size and shape of the standard (acoustic instrument) fingerboard. The player's left hand fingers the slats as if they were strings, and since the fingering action here also controls triggering and the loudness level, the player's right hand is free for other operations, such as manipulating waveform-variation controls and/or VCA controls, filters etc.

In order to provide an electronic substitute for the strings of a guitar, electric bass or other fretted instrument, four to six slats, each provided with its own frequency control strip, are arranged in parallel on a base the size and shape of the standard (acoustic instrument) fretboard. Again, the player's left hand fingers the slats as if they were strings, and since the fingering action also controls triggering and loudness level the player's right hand is free for other operations. The function of frets can be retained by providing indicia in the standard fret positions on the protective covering or other uppermost surface of each movable slat. The indicia may be either purely visual, such as colored or etched lines on the protective covering, or partly tactile, alternating, on the uppermost surface, both relatively wide smooth regions with narrower fret-like rough regions formed by scoring or grooving, for example, distributed along its length.

In order to provide an electronic instrument playable by a keyboard player, the slat would be about 2 inches wide and the protective covering would be formed with a black and white keyboard pattern. The black keys and the divisions between the white keys could be provided with a different tactile effect from the white keys themselves, as by rough surfaces. Such an instrument would have only monophonic capability. In order to provide 2-voice polyphonic capability, two such slats are placed end to end and each played by a different hand. In order to provide 4-voice polyphonic capability, an additional pair of slats, end to end, are placed slightly behind and slightly higher than the first pair, so that the entire assemblage looks like a 2-manual organ keyboard.

One problem with use of the frequency control strip described in the patent is that in a keyboard instrument the control strip is controlled by application of pressure within a narrow zone defined by that portion of the width of the resistive strip 8 which upon pressure establishes electrical contact with the metal strip 9, whereas the player of an instrument having a keyboard of standard pianoforte or professional-model organ dimensions is accustomed to applying finger-pressure within a much deeper zone, the maximum depth of which is the length of a long (white) piano key (5.75 inches), although the fingers are usually applied within a somewhat shallower zone (about 3 inches) which extends from the front edges of the long keys to slightly behind the front edges of the short (black) keys. In order to overcome this problem a resilient comb-like member is secured to the slat with the teeth extending perpendicular to the length of the slat and terminating superjacent the recording tape. If the comb is made of conductive material, it may be used in place of the metal strip 6 of the potentiometer of the patent, by omitting any protective covering over the recording tape and positioning the recording tape with its magnetic surface upward, facing the terminations of the teeth. A protective covering could then be provided over the comb, the protective covering having a printed black and white keyboard pattern. Alternatively, the metal strip could be retained, and the comb arranged so that when the teeth engage the recording tape the tape is pressed down into contact with the metal strip, just as it is pressed down by finger pressure into contact with the metal strip in the case of the control strip described in the patent. By use of a comb of suitable width, the musician may be provided with a finger-contact zone of standard depth (about 3 inches), since he can apply pressure at any point along the teeth, and the teeth transmit the pressure to the much shallower zone of the recording tape. In order to retain the desirable glissando control, the teeth should be as fine as possible so as to simulate an unbroken contact surface. If glissando control is regarded as relatively unimportant, the comb may be constructed to provide only one tooth for each key, and the teeth themselves may be black or white, as required for a conventional keyboard, and the black teeth could be positioned higher than the white teeth, in order to provide a three-dimensional keyboard surface.

According to a first aspect of the present invention there is provided a potentiometer, comprising a support member having first and second support regions and an intermediate region located therebetween, a resistive member supported on the support member at said first support region and having a longitudinal dimension extending transversely of a line from the first support region to the second support region, and a resilient contact member secured to the support member at said second support region and extending over the intermediate region and terminating superjacent the resistive member, the contact member being flexible both about axes which extend parallel to said line and about axes which extend transversely of said line, whereby application of pressure to the contact member at a location over said intermediate region causes the contact member to engage the resistive member and movement of the point of application of pressure perpendicular to said line causes the point of engagement of the resistive member by the contact member to move along the longitudinal dimension of the resistive member.

According to a second aspect of the present invention there is provided a potentiometer, comprising a support member having first and second support regions and an intermediate region located therebetween, resistance means supported on the support member at said first support region, comprising a resistive member and a sensing electrode which are spaced apart from each other but, on application of pressure, come into contact with each other, and having a longitudinal dimension extending transversely of a line from the first support region to the second support region, and the potentiometer also comprising a resilient contact member secured to the support member at said second support region and extending over the intermediate region and terminating superjacent the resistance means, the contact member being flexible both about axes which extend parallel to said line and about axes which extend transversely of said line, whereby application of pressure to the contact member at a location over said intermediate region causes the contact member to engage the resistance means and movement of the point of application of pressure perpendicular to said line causes the point of engagement of the resistance means by the contact member to move along the longitudinal dimension of the resistance means.

Certain of the improvements and modifications discussed above will now be described in further detail with reference to the accompanying drawings in which:

FIG. 5 shows a longitudinal sectional view of a first modification of the device illustrated in FIG. 1, while

FIG. 6 shows a vertical sectional view illustrating additional components of the FIGS. 1 and 5 devices, while FIG. 6A is an elevational view taken in the direction of the arrow VIA of FIG. 6 and FIG. 6B shows the electrical arrangement of these additional components;

FIG. 7 shows an end view of a second modification of the device shown in FIG. 1, while

FIG. 8 shows a longitudinal sectional view of a first modification of the FIG. 7 device, while

FIG. 9 shows a fragmentary plan view of a second modification of the FIG. 7 device, while

Figure 1:
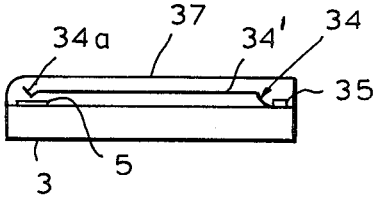
FIG. 1 shows a cross-sectional view of a device for generating a selected voltage.
Figure 2:
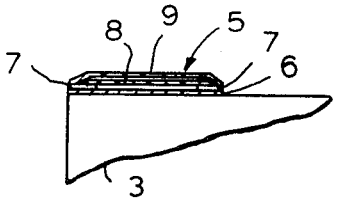
FIG. 2 shows a detail of the device illustrated in FIG. 1.

The device illustrated in FIG. 1 comprises a slat 3 which is mounted upon a support (not shown) in the same manner as the slat 3 of the patent. A frequency control strip 5 extends along one edge of the slat 3. As illustrated in FIG. 2, the frequency control strip comprises a metal strip 6 secured by adhesive on its underside to the upper surface of the slat 3, two lengths of spacer strip 7, for example double adhesive tape, covering the edges of the metal strip 6 but leaving the central area exposed, a resistive strip comprising a length of recording tape 8 having its edges secured to the spacer strips 7 of double adhesive tape and having its magnetic emulsion on its under surface (facing the metal strip 6), and a protective covering 9 of electrically nonconductive rayon ribbon.

Normally the spacer strips 7 of double adhesive tape keep the recording tape 8 spaced from the strip 6. However, when pressure is applied to the covering 9, the recording tape 8 is pressed onto the strip 6 and establishes electrical connection therewith. The electrical arrangement of the strip 6 and the tape 8 are as described in the patent.

A resilient member 34 is mounted on the slat 3 with one edge secured to the slat, along the opposite edge from the frequency control strip 5, by means of screws 35. An intermediate part 34' of the member 34 extends across the slat 3, perpendicular to its length, and slightly spaced above its upper surface. The free edge of the member 34 is bent at **34*a* downward and/or into a U-shape. It will be appreciated that since the member 34 is secured to the slat 3 along only one edge, the other edge being spaced from the slat, the member 34** is secured to the slat in cantilever fashion.

Figure 3:
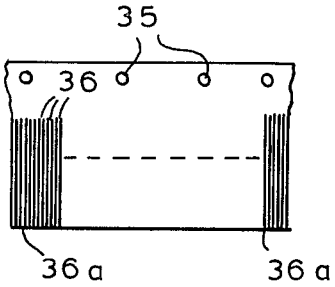
FIG. 3 shows a plan view of one component of the FIG. 1 device.

As in the case of the frequency control strip described in the patent, the recording tape is Scotch No. 208 having a resistance of about 50,000 ohms/inch. The width of the tape is one quarter inch. The depth of the part 34' of the member 34 is about 3 inches. The member 34 is flexible both about longitudinal axes extending parallel to its edges and about axes extending transversely of its edges. When pressure is applied to the intermediate part 34' of the member 34, the corresponding lowermost point of the edge **34*a* moves down into engagement with the protective covering 9 and thus presses the recording tape 8 into electrical connection with the metal strip 6. Thus, the member 34 serves as a transmission device for concentrating the effect of pressure applied at any point over a relatively deep area (the depth of the part 34') into a relatively shallow area (the width of the recording tape). Of course, the member 34 should not be so flexible about longitudinal axes that application of pressure to the member causes the entire edge 34*a* to move down into engagement with the protective covering 9. As illustrated in FIG. 3, the member 34 may be in the form of a comb having its back secured to the slat 3 by the screws 35 and the individual teeth 36 of the comb being so narrow and closely spaced that use of a single fingertip to apply pressure to the comb will press the tips 36*a* of several adjacent teeth simultaneously against the protective covering 9**.

Figure 4:
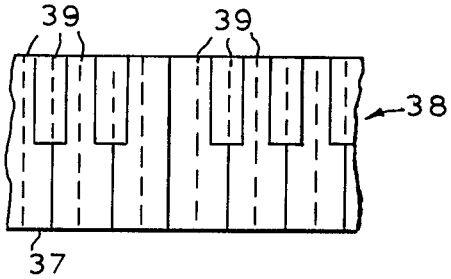
FIG. 4 shows a plan view of the device illustrated in FIG. 1.

The upper surface of the member 34 may be covered by a flexible protective covering 37 (which is preferably electrically inert), for example a plastic film, having on its upper surface a smooth and rough and/or black and white pattern 38, as shown in FIG. 4, similar to the pattern of black and white keys of a piano keyboard, and with lines 39, printed on or scored into its surface and extending perpendicular to the length of the slat near the middle of the key position, as a guide to the player showing the location of the underlying tooth which, on contacting the covering 9, produces a note of the exact or "correct" pitch for that key, for observance of the standards of fixed-intonation tuning.

In a modification of the device illustrated in FIGS. 1 and 2, the frequency control strip 5 comprises only a strip of recording tape which has its back surface secured to the slat, so that its magnetic coating is facing upwards, and the moving part of the frequency control strip comprises the member 34. In this case, the member 34 is made of conductive material and is connected in the same manner as the metal strip 6 of the frequency control strip 5 of the patent. Of course, in the case of this modification the protective covering 9 is not retained, but in order to prevent leakage currents and other perturbations when the musician presses the member 34 a protective covering is required and this must be made of electrically non-conductive material, such as plastic film. The covering may bear the same type of pattern and/or lines as the protective covering 37 of the device illustrated in FIGS. 1, 2 and 3. As in the case of FIG. 1, the member 34 may have a continuous intermediate portion 34', provided that it is sufficiently resistant to bending about the axes extending longitudinally of the slat, or the member 34 may be in the form of a comb with teeth 36.

It is preferred that the member 34 be in the form of a comb with teeth 36, rather than have a continuous intermediate part 34', because although suitable materials are available to produce the member 34 with a continuous intermediate part 34' (i.e. materials are available with suitable resilient and flexible qualities), the phyical properties of the member 34 depend upon the conditions under which the member was produced, and the conditions under which the material of the member 34 was produced, and change with time, and therefore the difference in flexible and resilient qualities about the different axes cannot be relied upon to obtain in the future, whereas in the case of a comb it is only necessary that each tooth remain flexible about axes extending longitudinally of the slat: flexibility of the member 34 about axes perpendicular to the slat is achieved by virtue of the member being in the form of a comb, not upon the physical properties of the material from which the member is made, and so will not be affected by passage of time.

Figure 5:
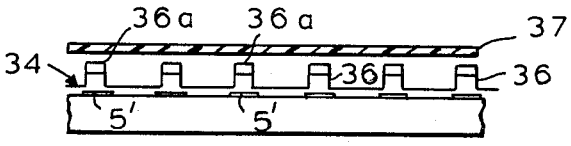
Figure 5A:
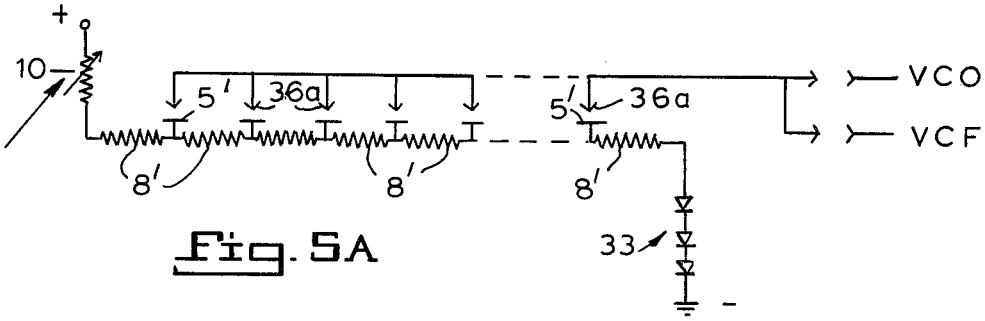
FIG. 5A is a circuit diagram showing the electrical circuit used with the FIG. 5 device.

In a further modification of the device illustrated in FIG. 1, the frequency control strip 5 is replaced by a series of discrete electrical contacts 5' illustrated in FIG. 5 which are connected to respective points of different potential in a chain of resistors 8', illustrated in FIG. 5A, which takes the place of the recording tape 8. In the case of the FIG. 5 embodiment, the intermediate portion of the member 34 may be continuous as in the case of the other described embodiments, but it is preferable that the member 34 should, as illustrated, be a comb having one tooth 36 for each of the discrete contacts 5'. It will be appreciated that each of the contacts 5' establishes a discrete voltage level which, when applied to a VCO, VCF or other unit whose pitch or frequency response is affected by voltage, establishes a predetermined frequency. Thus, the device illustrated in FIG. 5 is monophonic, and is especially well suited for playing fixed-intonation music.

As in the case of the device disclosed in the patent, in each of the devices illustrated in FIGS. 1 to 5 the slat 3 and the base member 1 upon which it is supported are provided with parts for generating an electrical analog signal dependent on the position of the slat with respect to the base member, and the device is also provided with means for generating a predetermined response when the slat is moved from a null position through an initiating threshold position against the bias established by a tension spring and for terminating the response when the support member is returned from beyond the initiating threshold position towards the null position through a termination threshold position. These additional components are illustrated in FIGS. 6, 6A and 6B and comprise light-emitting diodes 11 and 12, a light dependent resistor 13, a photodiode 14 and a trigger circuit 15. The light dependent resistor 13 is one component of a T-network 13*a*, which comprises in addition two resistors 13*b* and two capacitors 13*c*.

Figure 7:
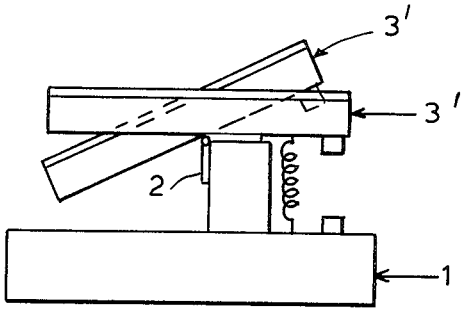
Figure 7A:
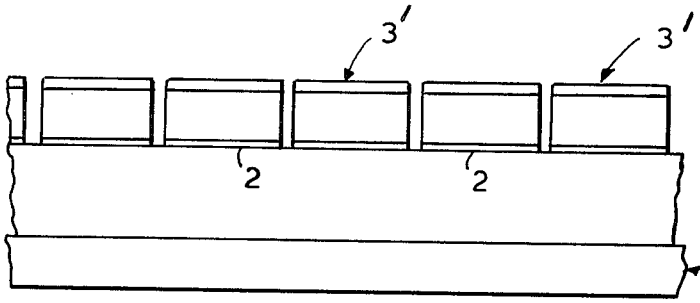
FIG. 7A shows a front elevation of the device.
Figure 7B:
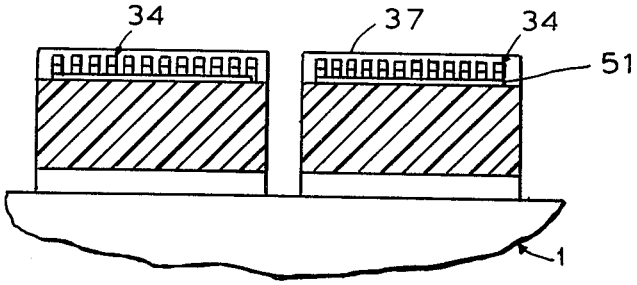
FIG. 7B shows a longitudinal sectional view, to an enlarged scale, of part of the device.
Figure 7C:
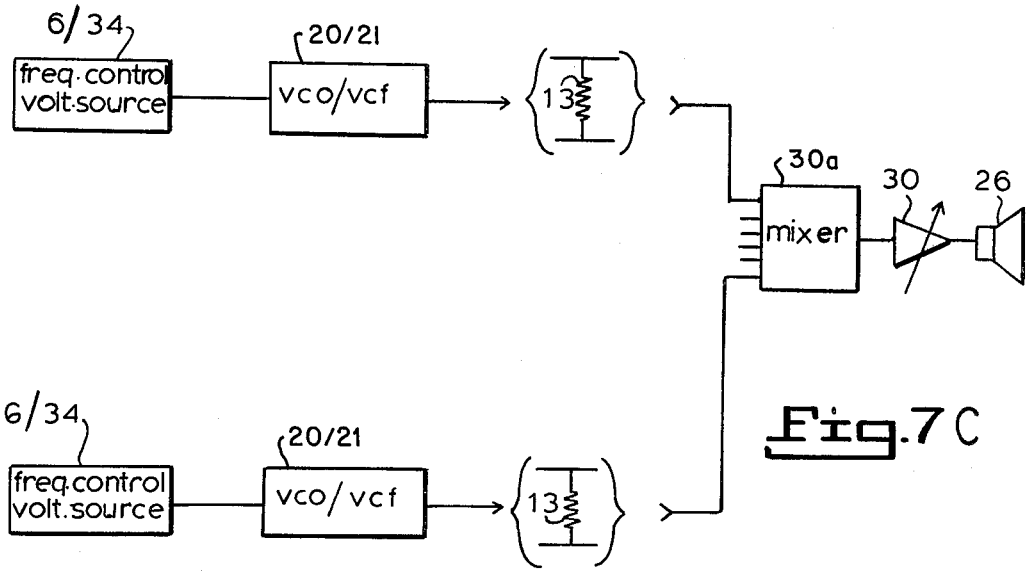
FIG. 7C shows a circuit diagram of this modification.

It is also possible to use the principles of the devices illustrated in FIGS. 1 to 5 to produce a polyphonic device. In such a device, a plurality of relatively short slats 3' forming keys are mounted side by side on a base member 1 as shown in FIGS. 7, 7A and 7B by means of respective hinges 2. Each of the keys 3' is provided with its own frequency control strip 51 and pressure transmitting member 34 having a solidly colored protective covering 37 above it displaying an in tune or exact pitch indicator line. Each frequency control strip 51 and pressure transmitting member 34 may be constructed as described with reference to FIGS. 1 and 2 or as described with reference to the modification in which the frequency control strip comprises only a strip of recording tape. The output from each of the metal strips 6 (in the case of the FIG. 1 construction) or from each of the members 35 (in the case of the modification) is processed in the same manner as the output from the metal strip 6 of the patent, up to but not including the power amplifier 30 and loudspeaker 26 shown in FIGS. 5 and 6 of the patent. In this polyphonic device, all the outputs from the VCO/VCF circuitry 20/21 fed by metal strips 6 or members 34 are individually attenuated by light-dependent resistors 13 associated with the respective keys 3' and are then mixed together in a mixer 30*a* and fed into a single power amplifier 30 driving a single loudspeaker 26, as illustrated in FIG. 7C.

Figure 8:
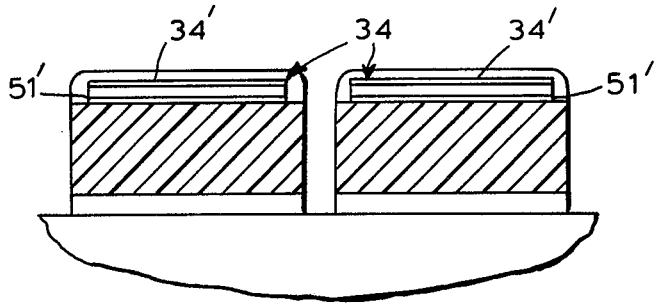

The device illustrated in FIGS. 7, 7A, and 7B may be modified in the light of the teaching of FIGS. 5 to 5A to provide a monphonic instrument, as illustrated in FIG. 8, in which each of the frequency control strips 51 is replaced by a discrete electrode 51' and the separate electrodes are connected as illustrated in FIG. 5A. The member 34 connected to each key 3' has a continuous intermediate portion 34' and is not in the form of a comb. However, in the case of FIGS. 7, 7A and 7B each individual key 3' has its own set of components for triggering and amplitude control. The different pressure transmitting members 34, of the keys 3' respectively, are connected together to a common output which is ultimately connected to a VCO, VCF or other unit whose pitch or frequency response is affected by voltage as shown in FIG. 5A. Of course, the respective protective coverings provided on the keys 3' respectively are solidly colored and since discrete contacts are used the coverings are not provided with in tune or exact pitch indicators as in the case of FIG. 7.

Figure 8A:
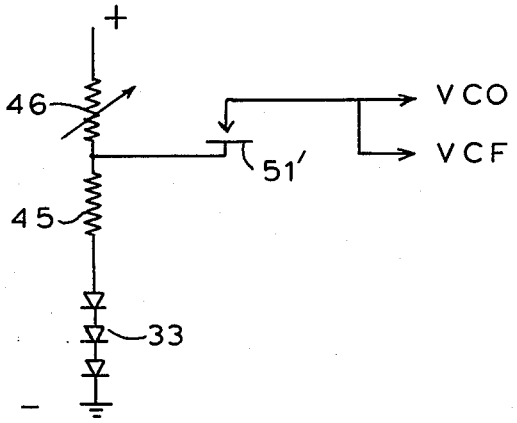
FIG. 8A is a circuit diagram of this modification.

The device of FIG. 8 may also be modified to provide a polyphonic device in which each key has a fixed intonation, rather than a variable intonation as in the case of the polyphonic device of FIGS. 7, 7A and 7B. In the case of this modification the electrodes 51' are connected to respective potential dividers, establishing discrete voltage levels for the electrodes, as shown in FIG. 8A. Each potential divider comprises a fixed resistor 45 and a variable trimmer resistor 46 connected in series with a diode drop 33 between the positive and negative poles of a D.C. voltage source. The different pressure transmitting members 34 are connected to respective VCO's and VCF's as in the case of FIG. 7C, and each key is provided with its own set of components for triggering and amplitude control.

Figure 9:
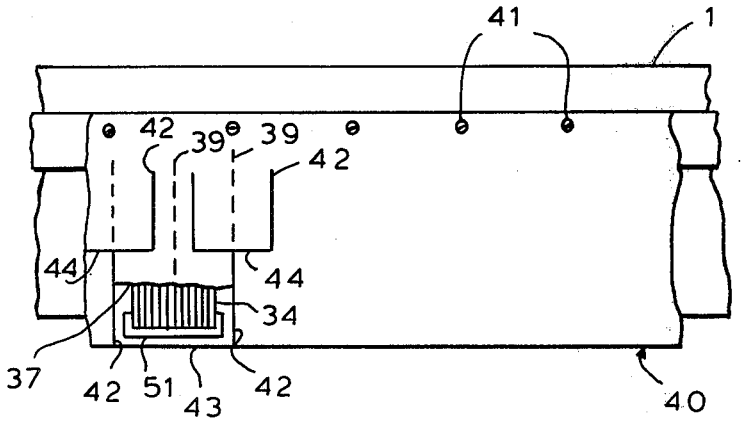

In a development shown in FIG. 9 of the device illustrated in FIGS. 7, 7A and 7B a single elongate member 40 of resilient material is secured on one of its two longer edges by screws 41 to a base member 1 and is formed with cuts 42 extending perpendicular to its other long edge and dividing that part of the member 40 which projects from the base member 1 into a series of long and short keys 43 and 44 respectively in such a way that the entire member 40, viewed from above, resembles a piano keyboard, with the length and width of each of the keys 43 and 44 equal to those of the corresponding piano keys. Each of the keys 43 and 44 has its own frequency control strip 51 attached to its upper surface adjacent the free end of the key, and its own pressure transmission member 34 covered by a solidly-colored protective covering 37 displaying an in tune or exact pitch indicator line 39. Each of the keys 43 and 44 carries near its free end a light-emitting diode 12 (shown in FIG. 9A) which illuminates a photodiode 14. Each frequency control strip 51 and pressure transmitting member 34 may constructed as described with reference to FIGS. 1 and 2 or as described with reference to the modification in which the frequency control strip comprises only a strip of recording tape. The output from each of the metal strips 6 (in the case of the FIG. 1 construction) or from each of the members 34 (in the case of the modification) is processed in the same manner as the output from the metal strip 6 of the patent, up to but not including the power amplifier 30 and loudspeaker 26 shown in FIG. 6 of the patent. In this polyphonic device, all the outputs from the VCO/VCF circuitry 20/21 fed by metal strips 6 or members 34 are individually attenuated by light-dependent resistors 13 associated with the respective keys 3' and are then mixed together in a mixer 30*a* and fed into a single power amplifier 30 driving a single loudspeaker 26, as illustrated in FIG. 9A.

Figure 9A:
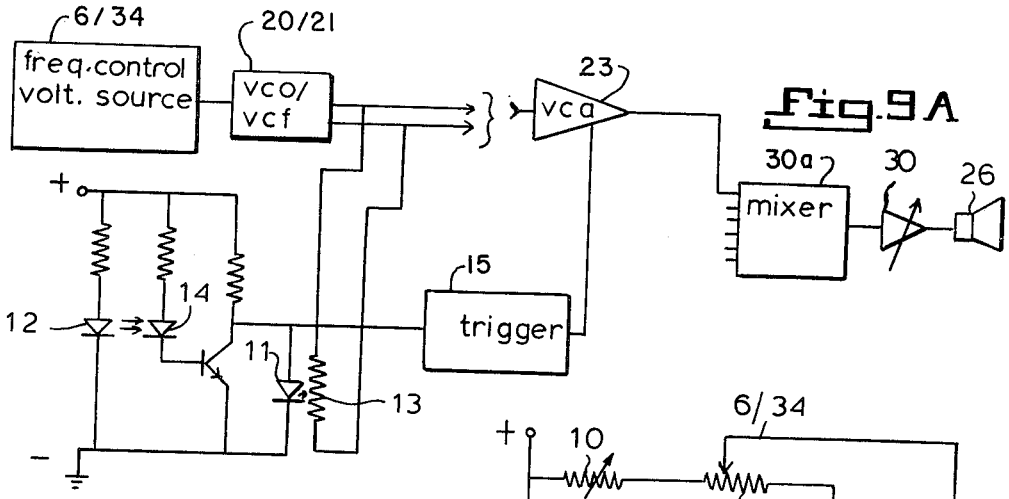
FIG. 9A shows a circuit diagram of this modification and FIG. 9B shows a circuit diagram of a modification of the FIG. 9 device.

The circuit illustrated in FIG. 9A corresponds to that illustrated in FIG. 6 of the patent, but a circuit corresponding to that illustrated in FIG. 5 could be used instead if, for example, each key carried a shutter which passed, on depression of the key, between two LED's (corresponding to the LED's 11 and 12 of the patent) and an LDR and a photodiode (corresponding to the LDR 13 and the photodiode 14 of the patent) so as to decrease the illumination of the LDR and the photodiode when increasing pressure is applied to the key.

In the case of the device described with reference to FIGS. 9 and 9A, each key 43 and 44 has its top surface coplanar with the top surfaces of the other teeth, when not subject to downward pressure. However, the entire one-piece member 40 may be molded or stamped in such a manner that the top surfaces of the shorter keys 44 would, when not subject to downward pressure, be coplanar with each other in a plane higher than that of the top surfaces of the longer keys 43, thus giving the entire member 40 the three dimensional pattern shown by the arrangement of black and white keys in a piano keyboard.

The device illustrated in FIGS. 9 and 9A could be modified to produce a monophonic keyboard by providing each of the teeth 43 and 44 with a single electrical contact instead of a frequency control strip, connected as in the case of the contacts 5' of FIGS. 5 and 5A. As in the monophonic modification of FIGS. 7, 7A and 7B, the member 34 of the monophonic modification of FIGS. 9 and 9A would have a continuous intermediate portion and would not be in the form of a comb.

Figure 9B:
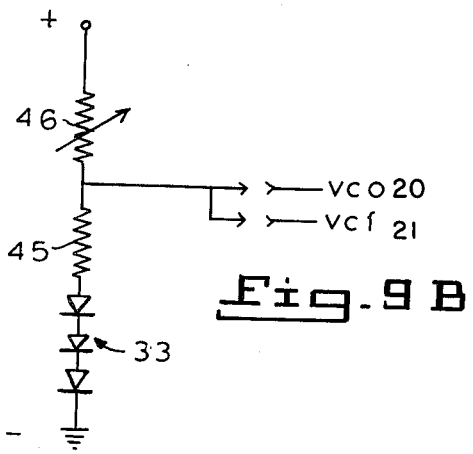

The monophonic modification of FIGS. 9 and 9A could be further modified to provide a polyphonic device having a fixed intonation for each key, rather than a variable intonation, in the manner described with reference to FIG. 8A, i.e. by using a plurality of potential dividers connected to the electrical contacts respectively and providing each key with its own set of components for triggering and amplitude control. In a simplified form of these polyphonic devices the contacts 34 and the discrete contacts associated therewith are replaced by direct connections between the potential dividers and the respective voltage-responsive variable frequency devices 20/21, as shown in FIG. 9B.

Figure 10:
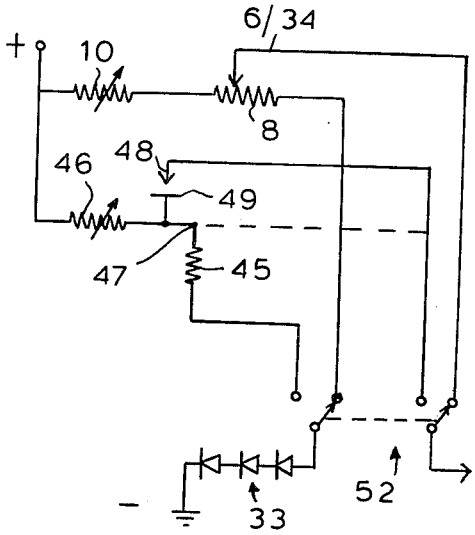
FIG. 10 shows a circuit diagram of a further modification of the FIG. 7 or 9 device.
Figure 11:
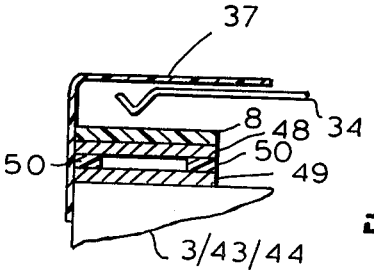
FIG. 11 shows a cross sectional view of one component of one version of the device employing the FIG. 10 circuit.

The polyphonic devices described above allow for variable intonation from each key. A polyphonic device may be produced to provide the user with a choice between variable intonation from each key and a fixed intonation from each key. In order to achieve this modification, each key is provided with a double pole, double throw switch 52, and in one position of the switch the output is taken from the metal strip 6 or the member 34 (depending upon whether the arrangement of the frequency control strip and the member 34 is as described with reference to FIG. 1 or the modification thereof) whereas in the other position of the switch the output is taken from a potential divider establishing a fixed voltage output. A suitable switching arrangement is illustrated in FIG. 10 of the drawings. As illustrated in FIG. 10, the positive terminal of a D.C. voltage source is connected to the negative pole thereof through a diode drop 33 and either a variable trimmer resistor 10 and the strip of tape 8 or through a fixed resistor 45 and a variable trimmer resistor 46, depending upon the position of the switch 52, and the output is received either from the metal strip 6 or member 34 or from the junction point of the resistors 45 and 46, depending upon the position of the switch 52. The connection to the junction point 47 may either be a permanent connection, as illustrated in broken line, or it may be a second movable contact 48 which is placed so that it establishes electrical connection with a nearby fixed metal contact 49, which is connected to the junction 47, when finger pressure is applied to the protective covering 37 on the key. In the case where the connection is made permanently to the junction point 47, and the fixed metal contact 49 and the associated movable contact 48 are omitted, the frequency control strip can be constructed in either of the two configurations described above. When the contacts 48 and 49 are employed, the frequency control strip is constructed in the configuration illustrated in FIG. 11. This modified form of frequency control strip comprises a metal strip, forming the contact 49, secured by adhesive on its under surface to the upper surface of the key 3', 43 or 44, a strip of flexible metal tape, such as aluminum foil sensing tape, forming the contact 48 and secured at its under surface to the contact 49 by two strips of double adhesive tape 50 covering the edges of the contact 49 but leaving the central area exposed, and a strip of recording tape, forming the tape 8, having its under surface secured by adhesive to the upper surface of the contact 48 and having its resistive coating on its upper surface, facing towards the pressure transmitting member 34. The pressure transmitting member 34 is covered by the protective covering 37. Normally the spacer strips 50 of double adhesive tape keep the contact 48 spaced from the contact 49, but when pressure is applied to the protective covering 37, the member 34 engages the tape 8 and the contact 48 is pressed onto contact with the contact 49 and establishes electrical connection therewith.

An additional and optional feature for a polyphonic keyboard configuration would be to have a single "glissando strip" placed in the very front of the keyboard and extending the full length of the latter. This "glissando strip" would be one complete monophonic form of the basic unit described in the patent, including a single movable slat, tension spring, motion-sensing devices, frequency-control strip, circuitry for converting an analog signal into a digital signal, attenuating circuitry, etc., and optionally including a transmission-comb and a protective covering over the latter.

Figure 12:
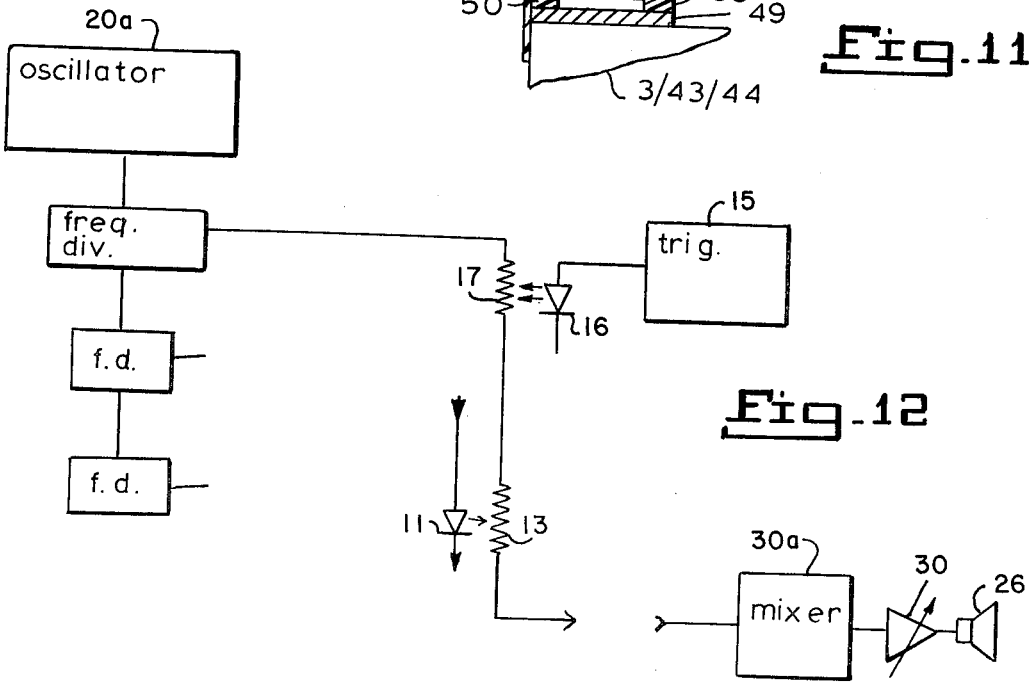
FIG. 12 shows a circuit diagram of a further modification of the device illustrated in FIGS. 9 and 9A.

The monophonic modifications of FIGS. 9 and 9A could be further modified to provide a polyphonic device having a fixed intonation for each key but not deriving the pertinent frequencies from a plurality of potential dividers but instead deriving them from connections to the outputs of electronic-organ oscillator circuitry [a one-octave set of oscillators **20*a*, each followed by a set of frequency dividers 20*a*, said connections feeding first through the gating circuitry 16, 17 of my triggering circuit 15 and then through the LDR 13 in my attenuation circuit 11, 12. See FIG. 12**.

It is to be understood that the invention is not limited to the specific constructions shown and described, as it will be apparent to those skilled in the art that changes may be made without departing from the principles of the invention as defined in the appended claims.

I claim:

1. A potentiometer, comprising a support member having first and second support regions and an intermediate region located therebetween, a resistive member supported on the support member at said first support region and having a longitudinal dimension extending transversely of a line from the first support region to the second support region, and a resilient contact member secured to the support member at said second support region in cantilever fashion and extending over the intermediate region and terminating superjacent the resistive member, the contact member being flexible both about axes which extend parallel to said line and about axes which extend transversely of said line, whereby application of pressure to the contact member at a location over said intermediate region causes the contact member to bend resiliently about an axis perpendicular to said line and to engage the resistive member and movement of the point of application of pressure perpendicular to said line causes the point of engagement of the resistive member by the contact member to move along the longitudinal dimension of the resistive member.

2. A potentiometer as claimed in claim 1, wherein the resistive member and the contact member are covered by a flexible protective covering which is secured to the support member.

3. A potentiometer as claimed in claim 1, wherein said resistive member comprises a strip of electrically-conductive material of relatively high resistance and said contact member is made of electrically-conductive material of relatively low resistance, so that when the ends of the strip are connected to opposite respective poles of a voltage source a voltage may be tapped off from the strip by way of the contact member by applying pressure to the intermediate region thereof, the tapped-off voltage being selectively variable by varying the position along the contact member at which pressure is applied thereto.

4. An electrical control device comprising a potentiometer as claimed in claim 1 and having an elongate support member which has its longitudinal dimension extending substantially parallel to the longitudinal dimension of the resistive member, and also comprising a base member and means mounting the support member on the base member so as to be movable in one direction transversely of its length with respect to said base member upon application of pressure to the intermediate region of the contact member, and the device further comprising biasing means to bias the support member against movement away from a null position in said one direction, and position pick-up means having a first part connected to said support member and a second part connected to said base member, said parts being arranged and connected to generate an electrical analog signal dependent on the position of said support member with respect to said base member, and the device also being provided with means for generating a predetermined response when said support member is moved from said null position through an initiating threshold position against said biasing means and for terminating said predetermined response when said support member is returned from beyond said initiating threshold position towards said null position through a termination threshold position.

5. An electrical control device comprising a plurality of potentiometers as claimed in claim 1, each having an elongate support member which has its longitudinal dimension extending substantially parallel to the longitudinal dimensions of the support members of the other potentiometers and substantially perpendicular to the longitudinal dimension of the resistive member of the potentiometer, and the device further comprising a base member and means mounting each support member on the base member so as to be movable in one direction transversely of the length of the resistive member with respect to said base member upon application of pressure to the intermediate region of the contact member, and the device further comprising, associated with each potentiometer, biasing means to bias the support member against movement away from a null position in said one direction, position pick-up means having a first part connected to said support member and a second part connected to said base member, said parts being arranged and connected to generate an electrical analog signal dependent on the position of said support member with respect to said base member, and means for generating a predetermined response when said support member is moved from said null position through an initiating threshold position against said biasing means and for terminating said predetermined response when said support member is returned from beyond said initiating threshold position towards said null position through a termination threshold position.

6. A potentiometer as claimed in claim 1, wherein the resilient contact member terminates at a position spaced from the resistive member, and application of pressure to the contact member at a location over said intermediate region causes the contact member to bend into engagement with the resistive member at a point over said first support region.

7. A potentiometer, comprising a support member having first and second support regions and an intermediate region located therebetween, resistance means supported on the support member at said first support region, comprising a resistive member and a second electrode which are spaced apart from each other but, on application of pressure, come into contact with each other, and having a longitudinal dimension extending transversely of a line from the first support region to the second support region, and the potentiometer also comprising a resilient contact member secured to the support member at said second support region and extending over the intermediate region and terminating superjacent the resistance means, the contact member being flexible both about axes which extend parallel to said line and about axes which extend transversely of said line, whereby application of pressure to the contact member at a location over said intermediate region causes the contact member to bend resiliently about an axis perpendicular to said line and to engage the resistance means, and movement of the point of application of pressure perpendicular to said line causes the point of engagement of the resistance means by the contact member to move along the longitudinal dimension of the resistance means, so that when the ends of said resistive member are connected to opposite respective poles of a voltage source a voltage may be tapped off from the resistive member by way of said sensing electrode by applying pressure to the intermediate region of the contact member, the tapped-off voltage being selectively variable by varying the position along the contact member at which pressure is applied thereto.

8. A potentiometer as claimed in claim 7, wherein the resistance means and the contact member are covered by a flexible protective covering which is secured to the support member.

9. An electrical control device comprising a potentiometer as claimed in claim 7 and having an elongate support member which has its longitudinal dimension extending substantially parallel to the longitudinal dimension of the resistance means, and also comprising a base member and means mounting the support member on the base member so as to be movable in one direction transversely of its length with respect to said base member upon application of pressure to the intermediate region of the contact member, and the device further comprising biasing means to bias the support member against movement away from a null position in said one direction, and position pick-up means having a first part connected to said support member and a second part connected to said base member, said parts being arranged and connected to generate an electrical analog signal dependent on the position of said support member with respect to said base member, and the device also being provided with means for generating a predetermined response when said support member is moved from said null position through an initiating threshold position against said biasing means and for terminating said predetermined response when said support member is returned from beyond said initiating threshold position towards said null position through a termination threshold position.

10. An electrical control device comprising a plurality of potentiometers as claimed in claim 7, each having an elongate support member which has its longitudinal dimension extending substantially parallel to the longitudinal dimensions of the support members of the other potentiometers and substantially perpendicular to the longitudinal dimension of the resistance means of the potentiometer, and the device further comprising a base member and means mounting each support member on the base member so as to be movable in one direction transversely of the length of the resistance means with respect to said base member upon application of pressure to the intermediate region of the contact member, and the device further comprising, associated with each potentiometer, biasing means to bias the support member against movement away from a null position in said one direction, position pick-up means having a first part connected to said support member and a second part connected to said base member, said parts being arranged and connected to generate an electrical analog signal dependent on the position of said support member with respect to said base member, and means for generating a predetermined response when said support member is moved from said null position through an initiating threshold position against said biasing means and for terminating said predetermined response when said support member is returned from beyond said initiating threshold position towards said null position through a termination threshold position.

11. A potentiometer as claimed in claim 7, wherein the resilient contact member terminates at a position spaced from the resistance means, and application of pressure to the contact member at a location over said intermediate region causes the contact member to bend into engagement with the resistance means at a point over said first support region.

12. A potentiometer as claimed in claim 3, wherein said contact member is electrically-conductive and is secured to the support member at said second support region and extends over the intermediate region and terminates superjacent the resistive member and spaced therefrom, so that when the ends of the resistive member are connected to opposite respective poles of a voltage source a voltage may be tapped off from the resistive member by way of the contact member by applying pressure to the intermediate region thereof, the tapped-off voltage being selectively variable by varying the position along the contact member at which pressure is applied thereto.

13. A potentiometer as claimed in claim 1 or 7, wherein said contact member is constructed as a comb having a plurality of teeth extending transversely of a common support part of the comb, the comb being secured at its common support part to said second support region and the teeth of the comb extending over said intermediate region and terminating superjacent the resistive member.

14. A potentiometer as claimed in claim 13, wherein each tooth of the comb is bent downwardly, towards said resistive member, at a point adjacent its end further from the common support part, and said end is swept upwardly.

15. A potentiometer as claimed in claim 2 or 8, wherein the protective covering is provided on its exposed surface with a pattern of keys of a keyboard instrument.

16. A potentiometer as claimed in claim 15, wherein the pattern is made up of black and white areas.

17. A potentiometer as claimed in claim 15, wherein the pattern is made up of smooth and rough areas.

18. A potentiometer as claimed in claim 7, wherein said resistive member comprises a strip of electrically-conductive material of relatively high resistance and said sensing electrode comprises a strip of electrically-conductive material of relatively low resistance, one of said strips being superjacent to but spaced from the other of said strips and being flexible so that it can be pressed into electrical contact with said other strip by pressure on the resistance means by said contact member.

* * * * *